US005788235A

United States Patent [19]

Thomas

[11] Patent Number: 5,788,235

[45] Date of Patent: Aug. 4, 1998

[54] BUSINESS RELATED BOARD GAME

[76] Inventor: Donald Thomas, 15111 Washngton Ave. Apt. 23, San Leandro, Calif. 94577

[21] Appl. No.: 897,902

[22] Filed: Jul. 21, 1997

[51] Int. Cl.[6] ..... A63F 3/00

[52] U.S. Cl. ..... 273/256

[58] Field of Search ..... 273/242, 243, 273/256, 278, 288

[56] References Cited

U.S. PATENT DOCUMENTS

| | | | |
|---|---|---|---|
| 2,976,044 | 3/1961 | Corpening | 273/256 |
| 3,163,423 | 12/1964 | Jackson | 273/256 |
| 3,756,604 | 9/1973 | Laszlo | 273/256 X |
| 3,994,499 | 11/1976 | Barlow | 273/256 |
| 4,871,177 | 10/1989 | Mock | 273/278 X |
| 4,934,707 | 6/1990 | Koster | 273/278 X |
| 5,388,836 | 2/1995 | Foti | 273/256 |
| 5,673,915 | 10/1997 | Shalders | 273/256 |

*Primary Examiner*—William E. Stoll

[57] ABSTRACT

A business related board game is provided with a game board, a plurality of license cards, and card holders. During play, each player may jointly purchase various token businesses and further take out loans for purchasing the token businesses, thereby simulating a business environment.

4 Claims, 2 Drawing Sheets

BUSINESS RELATED BOARD GAME

BACKGROUND OF THE INVENTION

1. Field of the Invention

The present invention relates to board games and more particularly pertains to a new business related board game for emulating a business environment.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art board games include U.S. Pat. No. 5,407,207; U.S. Pat. No. 4,902,020; U.S. Pat. No. 4,991,863; U.S. Pat. Des. No. 327,299; U.S. Pat. No. 4,932,668; and U.S. Pat. No. 4,354,684.

In these respects, the business related board game according to the present invention substantially departs from the conventional concepts and designs of the prior art, and in so doing provides an apparatus primarily developed for the purpose of emulating a business environment.

SUMMARY OF THE INVENTION

In view of the foregoing disadvantages inherent in the known types of board games now present in the prior art, the present invention provides a new business related board game construction wherein the same can be utilized for emulating a business environment.

The general purpose of the present invention, which will be described subsequently in greater detail, is to provide a new business related board game apparatus and method which has many of the advantages of the board games mentioned heretofore and many novel features that result in a new business related board game which is not anticipated, rendered obvious, suggested, or even implied by any of the prior art board games, either alone or in any combination thereof.

To attain this, the present invention generally comprises a game board is provided with a top face, a bottom face and a periphery. The game board has printed on the top face thereof a square central region with four interconnected linear side edges. Situated between the side edges of the central region and the periphery of the game board are four playing space strips. Each of such playing space strips have a plurality of linearly aligned playing spaces printed therein. A semicircle is formed between ends of each playing space strip. As shown in FIG. 1, the arcuate edges of the semicircular define a portion of the periphery of the game board. Next provided is a pair of rectangles printed on the central region adjacent opposite corners of the board. With reference now to FIG. 2, is can be seen that a plurality of card holders are provided each having a rectangular bottom face. Integrally coupled to the bottom face and extending upwardly therefrom a first predetermined height is a front face. A pair of side faces are also integrally coupled to the bottom face. Such side faces, however, extend upwardly therefrom a second predetermined height greater than the first predetermined height. Also included is a rear face integrally coupled to the bottom face and extending upwardly therefrom. Preferably, the rear face extends upwardly a third predetermined height greater than the second predetermined height. Associated therewith is an interior face having a top edge integrally coupled to a top edge of the rear face. The interior face extends downwardly and forwardly therefrom to integrally couple with the bottom face adjacent the front face. It should be noted that each player has a card holder. FIGS. 7–9 show a plurality of token money bills each with a rectangular configuration and positionable in an associated one of the card holders. Each token money bill has a predetermined numeral representative of an amount of money and money indicia printed thereon. As shown in FIG. 10, a die is included with six square sides each having a unique amount of dots imprinted thereon. Next provided is a plurality of unique playing pieces. Note FIG. 3. Each playing piece has a disk-shaped configuration with a periphery having a plurality of ridges formed therein. Also included is a plurality of license cards positionable within an associated one of the card holders. Each license card has an indicia printed thereon associated with that printed in one of the playing spaces. FIG. 5 shows a plurality of charity cards positionable within an associated one of the rectangles of the game board. Each charity card has printed thereon a first numeral representative of an amount of the money bills to be exchanged and/or an instruction stating an amount of playing spaces and a direction in which one of the playing pieces is required to be maneuvered. With reference now to FIG. 6, a plurality of auction cards are provided that are positionable within an associated one of the rectangles of the game board. Similar to the charity cards, each auction card has printed thereon at least one of a first numeral representative of an amount of the money bills to be exchanged and/or an instruction stating an amount of playing spaces and a direction in which one of the playing pieces is required to be maneuvered.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new business related board game apparatus and method which has many of the advantages of the board games mentioned heretofore and many novel features that result in a new business related board game which is not anticipated, rendered obvious, suggested, or even implied by any of the prior art board games, either alone or in any combination thereof.

It is another object of the present invention to provide a new business related board game which may be easily and efficiently manufactured and marketed.

It is a further object of the present invention to provide a new business related board game which is of a durable and reliable construction.

An even further object of the present invention is to provide a new business related board game which is susceptible of a low cost of manufacture with regard to both materials and labor, and which accordingly is then susceptible of low prices of sale to the consuming public, thereby making such business related board game economically available to the buying public.

Still yet another object of the present invention is to provide a new business related board game which provides in the apparatuses and methods of the prior art some of the advantages thereof, while simultaneously overcoming some of the disadvantages normally associated therewith.

Still another object of the present invention is to provide a new business related board game for emulating a business environment.

Even still another object of the present invention is to provide a new business related board game that includes a game board, a plurality of license cards, and card holders. During play, each player may jointly purchase various token businesses and further take out loans for purchasing the token businesses, thereby simulating a business environment..

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
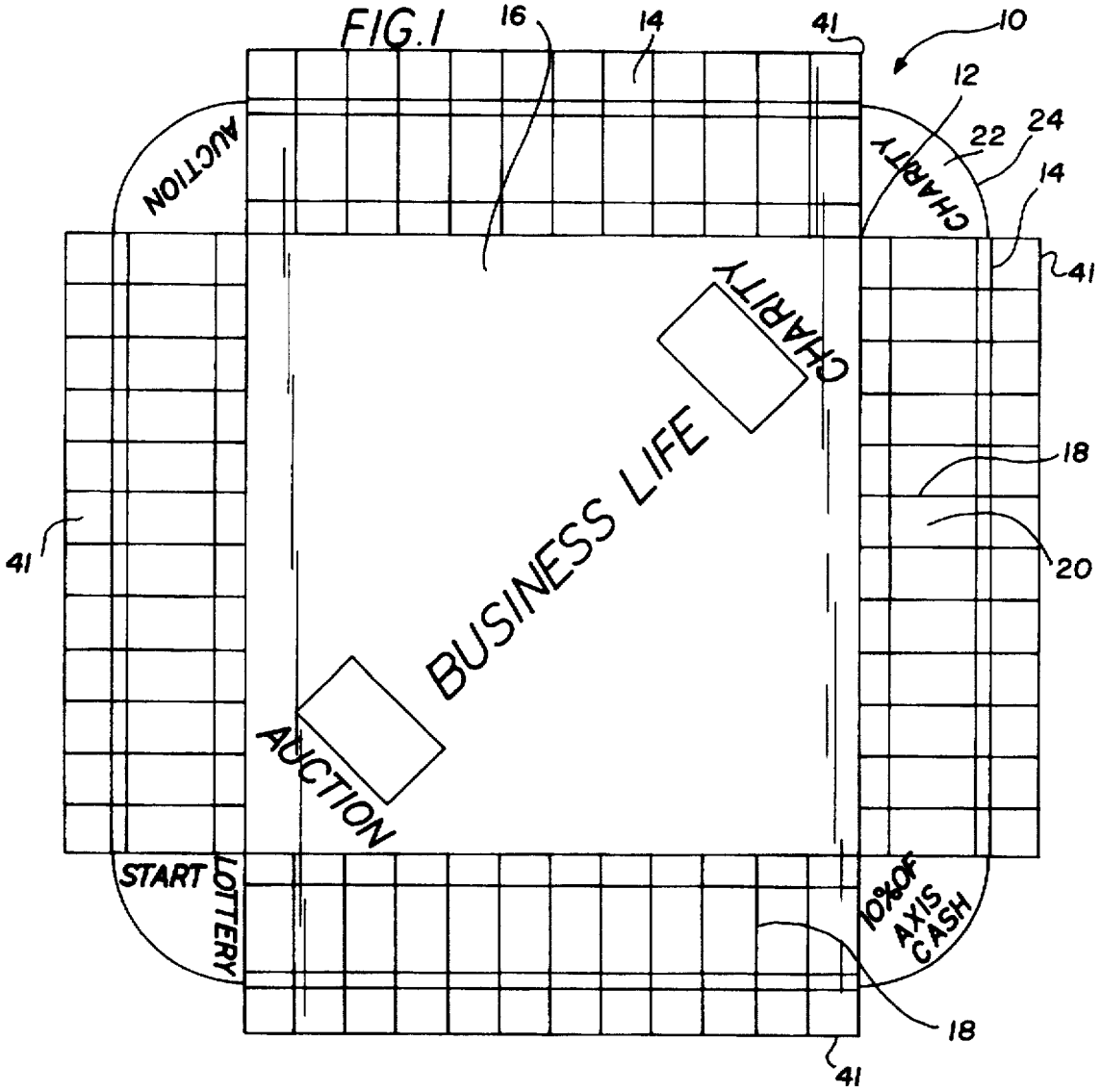
FIG. 1 is a plan view of the game board of the present invention with the card holders of each player situated adjacent thereto.

With reference now to the drawings, and in particular to FIGS. 1 through 10 thereof, a new business related board game embodying the principles and concepts of the present invention and generally designated by the reference numeral 10 will be described.

As shown in FIG. 1, a game board 12 is provided with a top face, a bottom face and a periphery 14. The game board has printed on the top face thereof a square central region 16 with four interconnected linear side edges. Situated between the side edges of the central region and the periphery of the game board are four playing space strips 18. Each of such playing space strips has a plurality of linearly aligned playing spaces 20 printed therein. While not shown, each of the playing spaces has printed therein an associated business related indicia. A semicircle 22, or quarter-circle, is formed between ends of each playing space strip. As shown in FIG. 1, the arcuate edges 24 of the semicircle define a portion of the periphery of the game board. Next provided is a pair of rectangles 26 printed on the central region adjacent opposite corners of the board.

Figure 2:
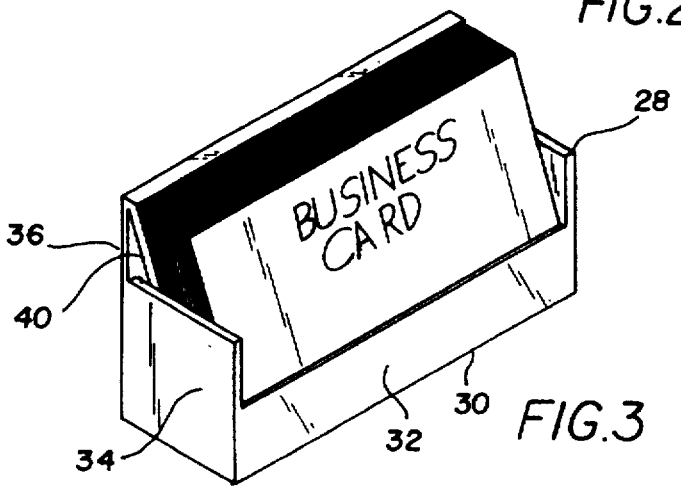
FIG. 2 is a perspective view of the card holders of the present invention.
Figure 3:
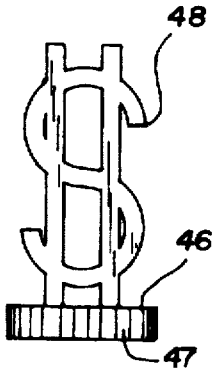
FIG. 3 is a side view of one of the playing pieces of the present invention.
Figure 4:
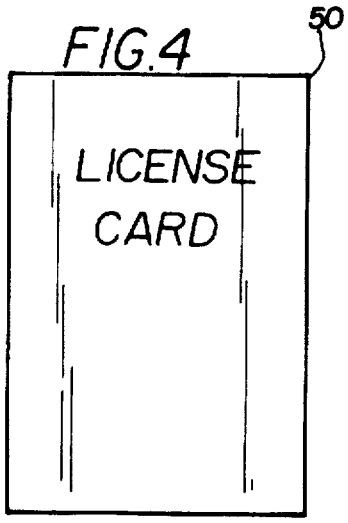
FIG. 4 is a top view of one of the license cards of the present invention.

With reference now to FIG. 2, is can be seen that a plurality of card holders 28 are provided each having a rectangular bottom face 30. Integrally coupled to the bottom face and extending upwardly therefrom a first predetermined height is a front face 32. A pair of side faces 34 are also integrally coupled to the bottom face. Such side faces, however, extend upwardly therefrom a second predetermined height greater than the first predetermined height. Also included is a rear face 36 integrally coupled to the bottom face and extending upwardly therefrom. Preferably, the rear face extends upwardly a third predetermined height greater than the second predetermined height. Associated therewith is an interior face 40 having a top edge integrally coupled to a top edge of the rear face. The interior face extends downwardly and forwardly therefrom to integrally couple with the bottom face adjacent the front face. It should be noted that each player has a card holder 41. Ideally, the card holders 41 of the players have an elongated length for supporting a plurality of cards in a side-by-side relationship. Note FIG. 1.

Figure 7:
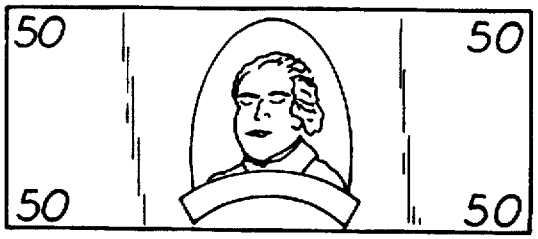
FIG. 7 is a top view of one of the token money bills of the present invention.
Figure 8:
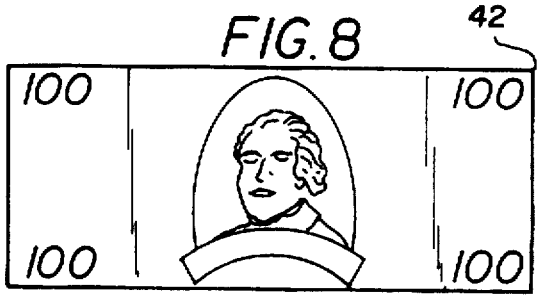
FIG. 8 is a top view of another one of the token money bills of the present invention.
Figure 9:
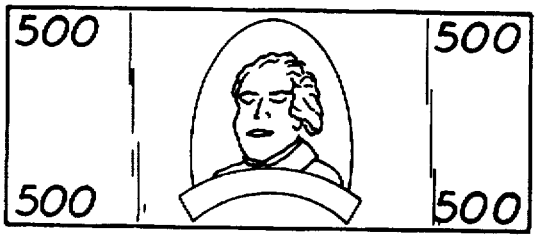
FIG. 9 is a top view of another one of the token money bills of the present invention.

FIGS. 7–9 show a plurality of token money bills 42 each with a rectangular configuration and positionable in an associated one of the card holders. Each token money bill has a predetermined numeral representative of an amount of money and money indicia printed thereon. A portion of the token money bills are shown in FIGS. 7–9. In the preferred embodiment, the numerals of the token money bills include "1", "5", "10", "20", "50", "100", & "1000".

Figure 10:
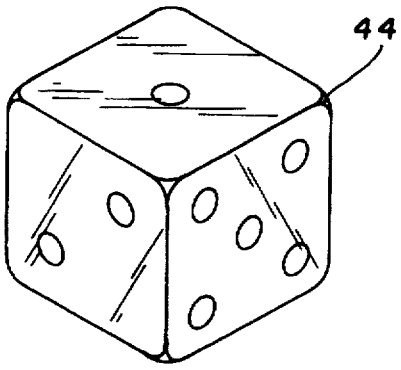
FIG. 10 is a perspective view of the die of the present invention.

As shown in FIG. 10, a die 44 is included with six square sides each having a unique amount of dots imprinted thereon.

Next provided is a plurality of unique playing pieces 46. Note FIG. 3. Each playing piece has a disk-shaped configuration with a periphery having a plurality of ridges 47 formed therein. Preferably, each playing piece is of a unique color. Further, the top face of each piece ideally has a money indicia-shaped member 48 extending upwardly therefrom for gripping purposes.

Also included is a plurality of business license cards 50 positionable within an associated one of the card holders. Each license card has an indicia printed thereon associated with that printed in one of the playing spaces.

Figure 5:
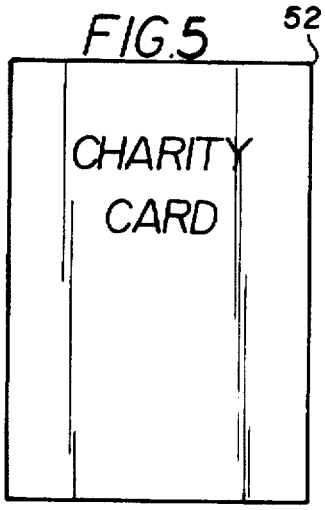
FIG. 5 is a top view of one of the charity cards of the present invention.

FIG. 5 shows a plurality of charity cards 52 positionable within an associated one of the rectangles of the game board. Each charity card has printed thereon a first numeral representative of an amount of the money bills to be exchanged and/or an instruction stating an amount of playing spaces and a direction in which one of the playing pieces is required to be maneuvered.

Figure 6:
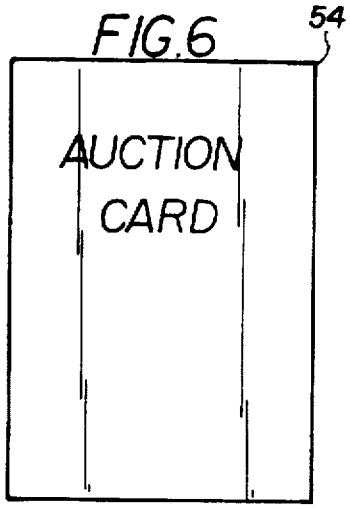
FIG. 6 is a top view of one of the auction cards of the present invention.

With reference now to FIG. 6, a plurality of auction cards 54 are provided that are positionable within an associated one of the rectangles of the game board. Similar to the charity cards, each auction card has printed thereon at least one of a first numeral representative of an amount of the money bills to be exchanged and/or an instruction stating an amount of playing spaces and a direction in which one of the playing pieces is required to be maneuvered.

It should be understood that the numerals representative of the an amount of money bills may refer to a money to be transferred either to or from the banker. Further, the instructions may include either an indication to traverse the playing spaces in a clockwise or counterclockwise manner. Included on each charity and auction card is a remark related to the amount of token money bills to be exchanged and/or the instruction.

The method associated with the present invention will now be described. First, one of the players is selected as a banker who distributes a predetermined amount of money to each of the players. Next the die is rolled to decide which player plays first. During each turn, the die is rolled to determine an amount of playing spaces that is traversed during the turn of each player. Upon landing on a first one of the semicircles, a player must pick one of the charity cards. Further, if a player lands on a second one of the semicircles, one of the auction cards is picked. Once one of the foregoing cards is picked, the player must carry out the instructions thereon. It should be noted that a third one of semicircles with "TAX" printed thereon requires the player who lands thereon to pay 10% of his total holdings. Also, a fourth one of the semicircles with "LOTTERY" printed thereon requires that a predetermined amount of token money is paid to the player who lands thereon.

Once a player has landed on one of the playing spaces, he or she may purchase the license card associated with the playing space for a predetermined amount of the token money bills. Upon another player landing on the foregoing playing space, a predetermined amount of the token money bills is collected by the player owning the license card associated therewith. It is important to note that the purchasing of the license card may be effected by two or more players as long as one of the players has landed on the associated playing space. Upon another player landing on the playing space owned by two different players, a predetermined amount of the token money bills is collected by the two or more players owning the corresponding license card.

To better simulate a business environment, a player may acquire a loan from the banker and in exchange transfer a predetermined amount of token money bills to the banker during each turn. The specific terms of such exchange may be worked out during each instance. Finally, each player has an option of forfeiting or selling one of the license cards thereof. This may only occur if there are not any token money bills being transferred to the banker by the owner of the license card.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for playing an economics related game comprising, in combination:

a game board with a top face, a bottom face and a periphery, the game board having printed on the top face thereof a square central region with four interconnected linear side edges, four playing space strips situated between the side edges of the central region and the periphery of the game board with a plurality of linearly aligned playing spaces printed therein, a semicircle formed between ends of each playing space strip, and a pair of rectangles printed on the central region adjacent opposite corners of the board;

a plurality of card holders each having a rectangular bottom face, a front face integrally coupled to the bottom face and extending upwardly therefrom a first predetermined height, a pair of side faces integrally coupled to the bottom face and extending upwardly therefrom a second predetermined height greater than the first predetermined height, a rear face integrally coupled to the bottom face and extending upwardly therefrom a third predetermined height greater than the second predetermined height, and an interior face having a top edge integrally coupled to a top edge of the rear face and extending downwardly and forwardly therefrom to integrally couple with the bottom face adjacent the front face, wherein each player has a card holder;

a plurality of token money bills each with a rectangular configuration and positionable in an associated one of the card holders, each token money bill having a predetermined numeral representative of an amount of money and money indicia printed thereon;

a die with six square sides each having a unique amount of dots imprinted thereon;

a plurality of unique playing pieces each having a disk-shaped configuration with a periphery having a plurality of ridges formed therein;

a plurality of license cards positionable within an associated one of the card holders, each license card having indicia printed thereon associated with that printed in one of the playing spaces;

a plurality of charity cards positionable within an associated one of the rectangles of the game board, each charity card having printed thereon at least one of a first numeral representative of an amount of the money bills to be exchanged and an instruction stating an amount of playing spaces and a direction in which one of the playing pieces is required to be maneuvered; and a plurality of auction cards positionable within an associated one of the rectangles of the game board, each auction card having printed thereon at least one of a first numeral representative of an amount of the money bills to be exchanged and an instruction stating an amount of playing spaces and a direction in which one of the playing pieces is required to be maneuvered.

2. A method of playing an economics related game comprising the steps of:

providing a game board with a top face, a bottom face and a periphery, the game board having printed on the top face thereof a square central region with four interconnected linear side edges, four playing space strips situated between the side edges of the central region and the periphery of the game board with a plurality of linearly aligned playing spaces printed therein, and a pair of rectangles printed on the central region adjacent opposite corners of the board;

providing a plurality of card holders;

providing a plurality of token money bills each with a rectangular configuration and positionable in an associated one of the card holders, each token money bill having a predetermined numeral representative of an amount of money and money indicia printed thereon;

providing a die with six square sides each having a unique amount of dots imprinted thereon;

providing a plurality of unique playing pieces each having a disk-shaped configuration with a periphery having a plurality of ridges formed therein;

providing a plurality of license cards positionable within an associated one of the card holders, each license card having indicia printed thereon associated with that printed in one of the playing spaces;

selecting one of the players as a banker;

distributing a predetermined amount of money to each of the players;

rolling the dice during each turn to determine an amount of playing spaces traversed during the turn of each player;

purchasing the license card associated with one of the playing spaces which has been landed on for a predetermined amount of the token money bills, whereby upon another player landing on said playing space, a predetermined amount of the token money bills is collected by the player owning the license card associated therewith, wherein the purchasing of the license card may be effected by two or more players as long as one of the players has landed on the associated playing space, whereby upon another player landing on the playing space, a predetermined amount of the token money bills is collected by the two or more players owning the license cards;

acquiring a loan from the banker and in exchange transferring a predetermined amount of the token money bills to the banker during each turn; and forfeiting one of the player's license cards only if there are not any token money bills being transferred to the banker by the owner of the license card.

3. A method of playing an economics related game as set forth in claim 2 wherein each card holder has a rectangular bottom face, a front face integrally coupled to the bottom face and extending upwardly therefrom a first predetermined height, a pair of side faces integrally coupled to the bottom face and extending upwardly therefrom a second predetermined height greater than the first predetermined height, a rear face integrally coupled to the bottom face and extending upwardly therefrom a third predetermined height greater than the second predetermined height, and an interior face having a top edge integrally coupled to a top edge of the rear face and extending downwardly and forwardly therefrom to integrally couple with the bottom face adjacent the front face, wherein each player has a card holder.

4. An method of playing an economics related game comprising the steps of:

providing a game board with a top face, a bottom face and a periphery, the game board having printed on the top face thereof a square central region with four interconnected linear side edges, four playing space strips situated between the side edges of the central region and the periphery of the game board with a plurality of linearly aligned playing spaces printed therein, a semicircle formed between ends of each playing space strip, and a pair of rectangles printed on the central region adjacent opposite corners of the board;

providing a plurality of card holders each having a rectangular bottom face, a front face integrally coupled to the bottom face and extending upwardly therefrom a first predetermined height, a pair of side faces integrally coupled to the bottom face and extending upwardly therefrom a second predetermined height greater than the first predetermined height, a rear face integrally coupled to the bottom face and extending upwardly therefrom a third predetermined height greater than the second predetermined height, and an interior face having a top edge integrally coupled to a top edge of the rear face and extending downwardly and forwardly therefrom to integrally couple with the bottom face adjacent the front face, wherein each player has a card holder;

providing a plurality of token money bills each with a rectangular configuration and positionable in an associated one of the card holders, each token money bill having a predetermined numeral representative of an amount of money and money indicia printed thereon;

providing a die with six square sides each having a unique amount of dots imprinted thereon;

providing a plurality of unique playing pieces each having a disk-shaped configuration with a periphery having a plurality of ridges formed therein;

providing a plurality of license cards positionable within an associated one of the card holders, each license card having indicia printed thereon associated with that printed in one of the playing spaces;

providing a plurality of charity cards positionable within an associated one of the rectangles of the game board, each charity card having printed thereon at least one of a first numeral representative of an amount of the money bills to be exchanged and an instruction stating an amount of playing spaces and a direction in which one of the playing pieces is required to be maneuvered;

providing a plurality of auction cards positionable within an associated one of the rectangles of the game board, each auction card having printed thereon at least one of a first numeral representative of an amount of the money bills to be exchanged and an instruction stating an amount of playing spaces and a direction in which one of the playing pieces is required to be maneuvered;

selecting one of the players as a banker;

distributing a predetermined amount of money to each of the players;

rolling the die to decide which player plays first;

rolling the dice during each turn to determine an amount of playing spaces traversed during the turn of each player;

picking one of the charity cards upon landing on a first one of the semicircles;

picking one of the auction cards upon landing on a second one of the semicircles;

purchasing the license card associated with one of the playing spaces which has been landed on for a predetermined amount of the token money bills, whereby upon another player landing on said playing space, a predetermined amount of the token money bills is collected by the player owning the license card associated therewith, wherein the purchasing of the license card may be effected by two or more players as long as one of the players has landed on the associated playing space, whereby upon another player landing on the playing space, a predetermined amount of the token money bills is collected by the two or more players owning the license cards;

acquiring a loan from the banker and in exchange transferring a predetermined amount of the token money bills to the banker during each turn; and forfeiting one of the player's license cards only if there are not any token money bills being transferred to the banker by the owner of the license card.

* * * * *